US011718498B1

(12) United States Patent
Stanton

(10) Patent No.: US 11,718,498 B1
(45) Date of Patent: Aug. 8, 2023

(54) ADJUSTABLE SPOOLING APPARATUS

(71) Applicant: Martin P Stanton, Trinity, FL (US)

(72) Inventor: Martin P Stanton, Trinity, FL (US)

( * ) Notice: Subject to any disclaimer, the term of this patent is extended or adjusted under 35 U.S.C. 154(b) by 145 days.

(21) Appl. No.: 17/464,894

(22) Filed: Sep. 2, 2021

Related U.S. Application Data

(60) Provisional application No. 63/074,006, filed on Sep. 3, 2020.

(51) Int. Cl.
*B65H 75/06* (2006.01)
*B65H 75/24* (2006.01)
*B65H 75/22* (2006.01)

(52) U.S. Cl.
CPC ..... *B65H 75/248* (2013.01); *B65H 75/06* (2013.01); *B65H 75/2209* (2021.05); *B65H 2701/34* (2013.01)

(58) Field of Classification Search
CPC .. B65H 75/06; B65H 75/248; B65H 75/2209; B65H 2701/34
See application file for complete search history.

(56) References Cited

U.S. PATENT DOCUMENTS

| | | | | |
|---|---|---|---|---|
| 3,817,471 | A * | 6/1974 | Finneman | B65H 75/06 242/406 |
| 7,395,985 | B2 * | 7/2008 | Lazarro | B65H 75/06 242/405.1 |
| 7,455,258 | B2 * | 11/2008 | Proebstle | B65H 75/06 242/405.1 |
| 11,427,430 | B2 * | 8/2022 | Borgelt | B65H 75/406 |
| 11,584,611 | B2 * | 2/2023 | Cheng | B65H 75/30 |
| 2009/0108113 | A1 * | 4/2009 | Chen | B65H 75/06 242/129 |

* cited by examiner

*Primary Examiner* — Sang K Kim
(74) *Attorney, Agent, or Firm* — Goldstein Law Offices, P.C.

(57) ABSTRACT

An adjustable spooling apparatus for storing and unwinding a cable formed into a coil and having a coil diameter, the adjustable spooling apparatus comprising a central hub, a pair of adjustable arms movably engaged with the central hub, and a rotating handle. The adjustable arms each have a coil retention member, and can be selectively extended or retracted to increase or decrease a retention member distance measured between the coil retention members of the two adjustable arms to match the coil diameter. The rotating handle is attached to the central hub, and allows the adjustable spooling apparatus to rotate when the cable is pulled to facilitate unwinding of the coil. The adjustable spooling apparatus further comprises a pair of pivoting arms to prevent the coil from being dislodged, and an engagement point for a power tool to facilitate rapid winding of the cable by rotating the adjustable spooling apparatus.

16 Claims, 14 Drawing Sheets

ADJUSTABLE SPOOLING APPARATUS

CROSS-REFERENCE TO RELATED APPLICATIONS

This application is a nonprovisional utility application of provisional patent application, Ser. No. 63/074,006 filed in the United States Patent Office on Sep. 3, 2020, claims priority therefrom, and is expressly incorporated herein by reference in its entirety.

TECHNICAL FIELD

The present disclosure relates generally to an apparatus and methods for storing and unwinding cabling such as electrical cords, wires, and lines. More particularly, the present disclosure relates to an adjustable apparatus for storing and unwinding cabling, and methods for its use.

BACKGROUND

Electric cabling of significant length, such as power cords, digital transmission cables, extension cords, and the like, are indispensable when operating electric tools, lights, or various electronic instruments and devices. However, due to their length, the cables are very difficult to transport, wind, and unwind, and require users to take great care to avoid entangling the cables during use.

There are various techniques commonly employed to wind cables to produce coils. For example, a user may wind a cable around the user's forearm between the elbow and thumb to create an elliptically shaped coil. The user may also employ the "over and under" technique which is popular with audio and video technicians, by coiling the cable using alternating overhand and underhand loops. However, pre-wound coils are difficult to transport and unwind without the cable becoming loosened, causing the coil to lose its shape. Once the coil has lost its shape, unwinding the coil will cause the cable to become snagged or entangled.

Although various cable winding and unwinding devices such as cable storage reels may be found within the prior art, these devices require the cable to be wound directly over the device. Longer cables will require a larger, bulkier reel, resulting in increased weight and bulk. In use cases where the user must work with multiple coiled cables, storage reels may prove impractical to transport and carry. Furthermore, these devices are fixed in size, and the user maybe be unable to store long cables using a small reel. Similarly, it would be extremely inefficient to use a large reel to store a relatively short cable.

A need therefore exists for a single adjustable device which can be used to store, transport, and unwind coils of varying lengths. Furthermore, such an adjustable device will be able to store pre-wound coils, as well as allow cables to be wound directly onto the adjustable device.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide an apparatus for storing a cord or cable wound into a coil with a coil central space, which is capable of being adjusted to securely store coils of varying diameters. Accordingly, the present disclosure provides an adjustable spooling apparatus, comprising a central hub and a pair of adjustable arms arranged in parallel astride the central hub. The adjustable arms are slidably attached to the central hub via extension guides. Each adjustable arm has a coil retention member, and the adjustable arms are adapted to selectively extend or retract to increase or decrease a retention member distance measured between the coil retention members. The retention member distance is adjusted to match the diameter of the coil, allowing the pre-wound coil to be placed directly over the two coil retention members such that the coil retention members contact the coil within the coil central space.

It is another aspect of an example embodiment in the present disclosure to provide an apparatus which allows the coil stored thereon to be unwound. Accordingly, the adjustable spooling apparatus further has a rotating handle attached to the central hub. When the cable is pulled away from the adjustable spooling apparatus, the pulling force causes the adjustable spooling apparatus to rotate about the rotating handle, and the rotation facilitates the unwinding of the coil from around the coil retention members.

It is yet another aspect of an example embodiment in the present disclosure to provide an apparatus which can be both handheld or attached to a vertical surface to facilitate unattended operation. Accordingly, the rotating handle has a handle recess, which allows the rotating handle to be attached to a mounting peg which projects from a vertical surface, thus allowing the adjustable spooling apparatus to be secured to the vertical surface in an orientation parallel thereto. The adjustable spooling apparatus rotates about the rotating handle when the cable is pulled while remaining attached to the vertical surface, allowing the user to move away from the adjustable spooling apparatus while continuing to unwind the coil.

It is a further aspect of an example embodiment in the present disclosure to provide an apparatus which prevents the coil from being dislodged from the coil retention members. Accordingly, each adjustable arm further has a pivoting arm attached to the coil retention member. The pivoting arms are placed in a raised position which allows the coil to be placed upon the adjustable spooling apparatus. Once the coil has been placed in contact with the coil retention members, the pivoting arms are placed in a lowered position which pushes the coil downwardly against the adjustable arms, thus preventing the coil from being lifted free of the coil retention members. Furthermore, the adjustable spooling apparatus may further comprise a pair of retention clips, each positioned upon one of the adjustable arms. The retention clips are formed of an elastic material, and are adapted to grip the cable to prevent the cable from dangling and causing the coil to partially unwind.

It is still a further aspect of an example embodiment in the present disclosure to provide an apparatus which allows the cable to be wound into a coil directly over the coil retention members with the aid of a power tool, thus allowing cables of significant length to be wound quickly. Accordingly, the central hub further has an engagement point positioned in line with the rotating handle, which is adapted to receive a power tool bit of a power tool. Once the rotating handle is secured by hand, or is mounted to a vertical surface, the engagement point allows the power tool to rotate the adjustable spooling apparatus, further allowing the cable to be wound into a coil directly over coil retention members.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
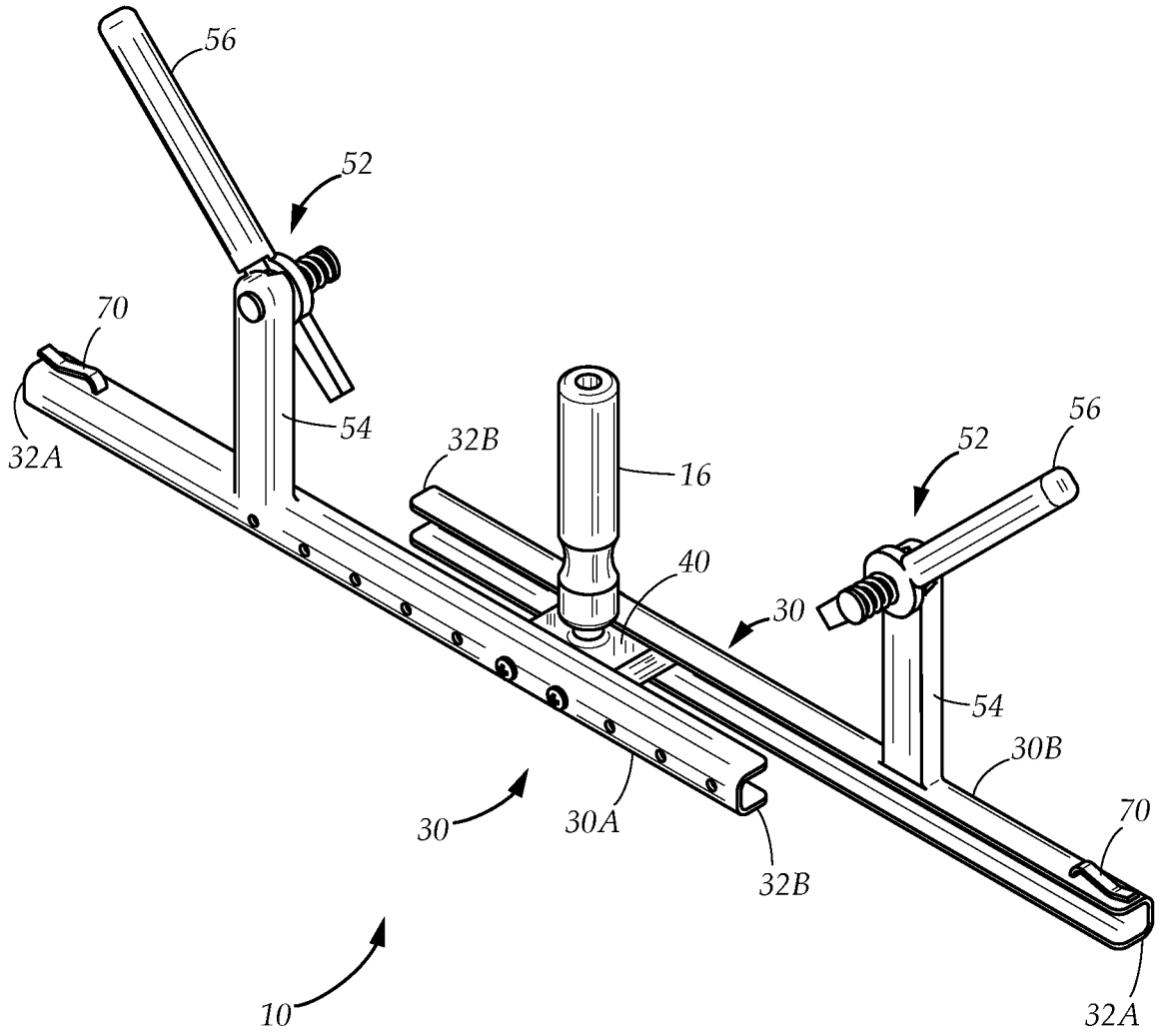
FIG. 1 is a diagrammatic perspective view of an adjustable spooling apparatus, in accordance with an embodiment in the present disclosure.
Figure 2:
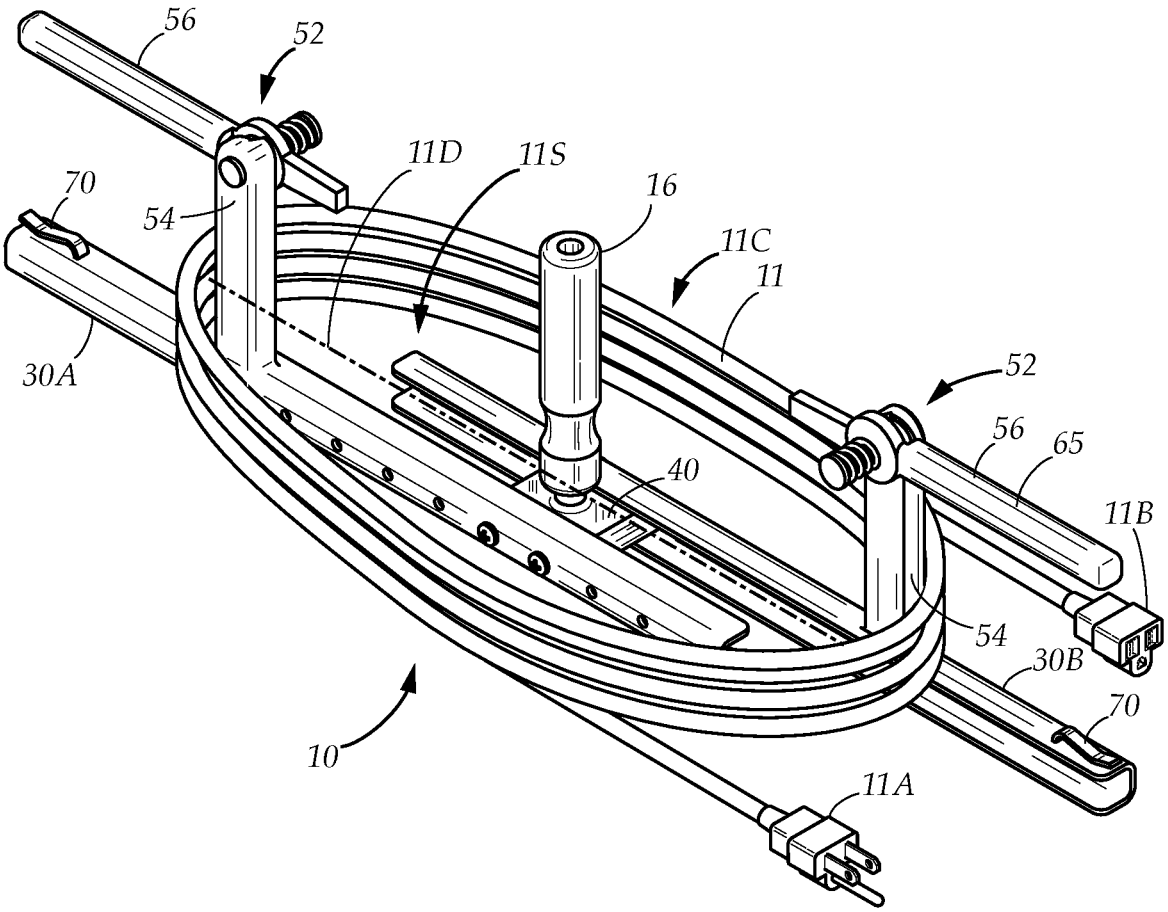
FIG. 2 is a diagrammatic perspective view of the adjustable spooling apparatus holding a cable wound into a coil between a pair of coil retention assemblies, in accordance with an embodiment in the present disclosure.

FIG. 1 and FIG. 2 illustrate an adjustable spooling apparatus 10 for storing a coil 11C of cable 11, and facilitating the unwinding thereof. The cable 11 has two cable ends comprising a first cable end 11A and a second cable end 11B, and can be a line, electrical cord, wire, rope, or other similar elongated apparatus having a limited thickness and significant length. The coil 11C has an elliptical or oval shape with an open coil central space 11S, and is formed by looping or winding the cable 11. The coil 11C further has a coil diameter 11D, which corresponds to the major axis of the coil 11C as measured across the coil central space 11S, or the diameter of the coil central space 11S at is widest.

Figure 4:
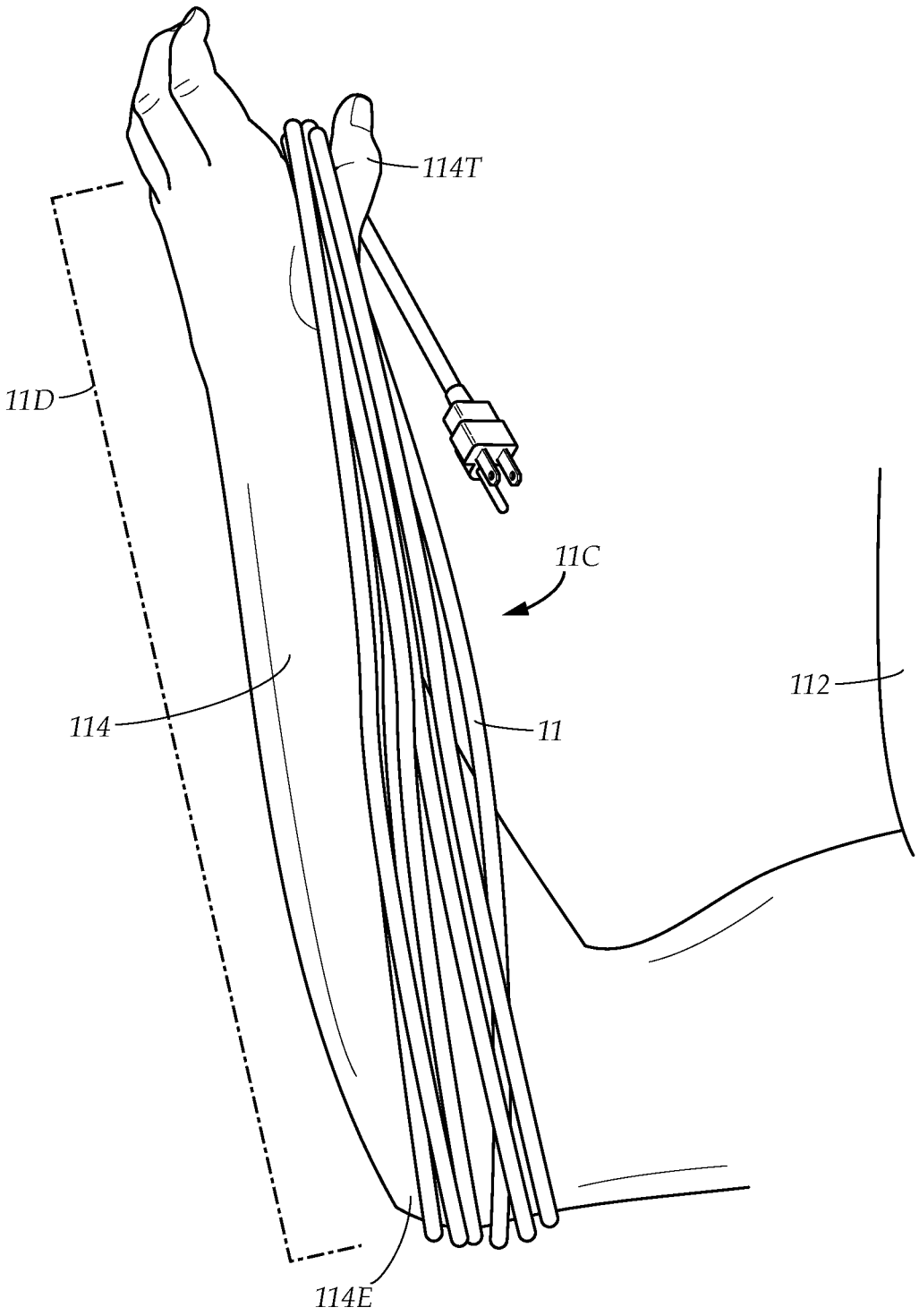
FIG. 4 is a diagrammatic side view of a cable being wound into a coil around a user's arm, in accordance with an embodiment in the present disclosure.

Referring to FIG. 4 while also referring to FIG. 2, the cable 11 may be wound into a coil 11C using a variety of techniques. For example, the cable 11 may be wound around a forearm 114 of a user 112, between the user's 112 elbow 114E and thumb 114T to produce a coil 11C. When employed by the same user 112, this technique produces coils 11C which have a near consistent coil diameter 11D, as the coil diameter 11D will substantially match the distance between the thumb 114T and elbow 114E of the user 112. Alternatively, the cable 11 may be wound into a coil 11C using any technique known to persons of ordinary skill in the art in the field of the invention, such as the "over and under" cable wrapping technique.

Returning to FIG. 1 and FIG. 2, the adjustable spooling apparatus 10 comprises a central hub 40, a pair of substantially identical adjustable arms 30 movably engaged with the central hub 40, and a rotating handle 16 attached to the central hub 40. The rotating handle 16 is positioned perpendicularly in relation to the central hub 40 and the adjustable arms 30, and is adapted to rotate freely in relation to the central hub 40. The adjustable arms 30 comprise a first adjustable arm 30A and a second adjustable arm 30B which are arranged in parallel, and each adjustable arm 30 has a coil retention assembly 52. Each coil retention assembly 52 comprises a coil retention member 54 which projects orthogonally from the adjustable arm 30. The adjustable spooling apparatus 10 is used to store the coil 11C, by placing the coil 11C over the adjustable spooling apparatus 10 with the two coil retention members 54 projection through the coil central space 11S and in contact with portions of the cable 11 adjoining the coil central space 11S.

Figure 3A:
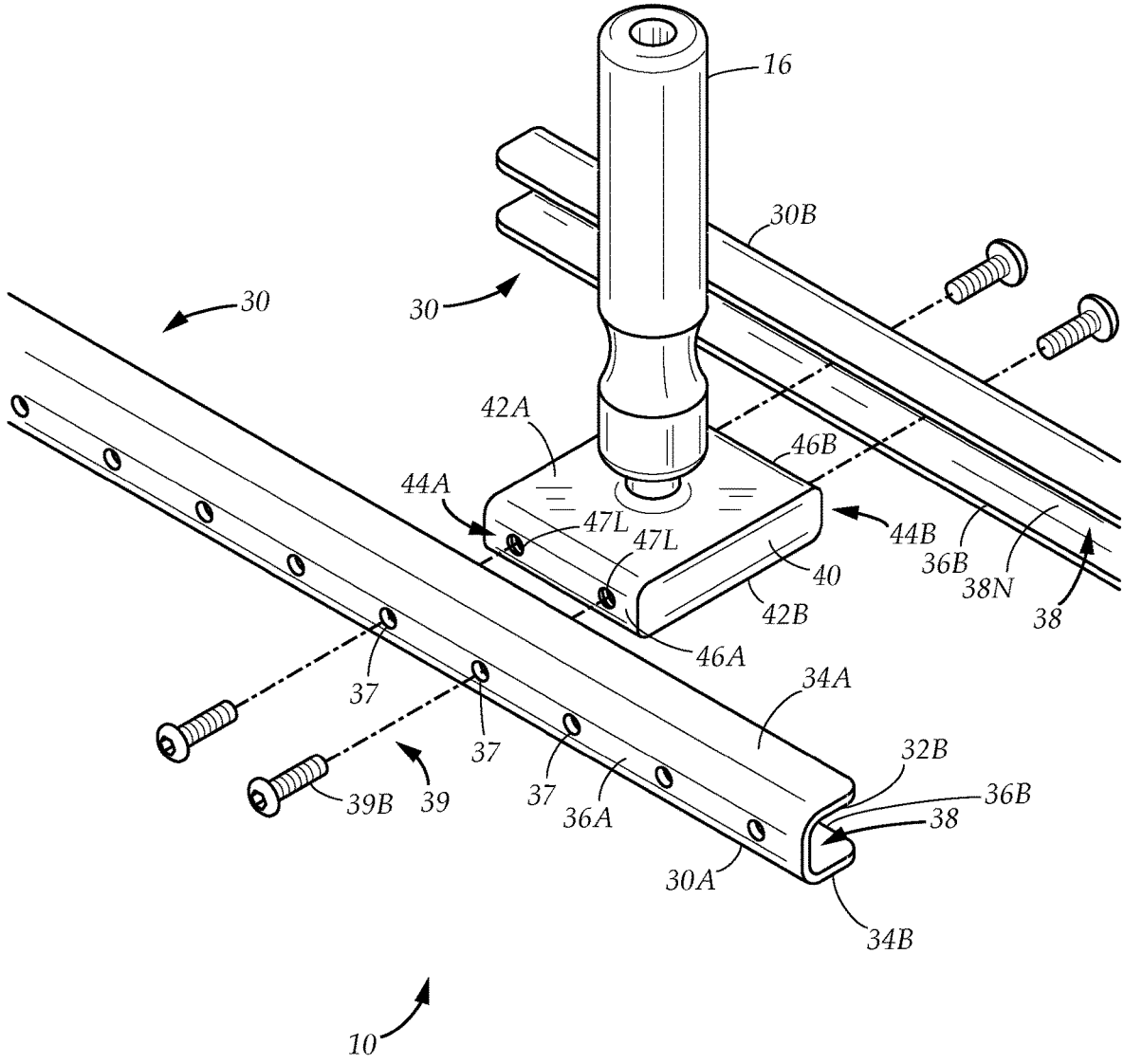
FIG. 3A is a diagrammatic exploded view of the adjustable spooling apparatus, depicting two adjustable arms, a central hub with rotating handle, and an arm locking mechanism, in accordance with an embodiment in the present disclosure.
Figures 3B, 3C, 3D:
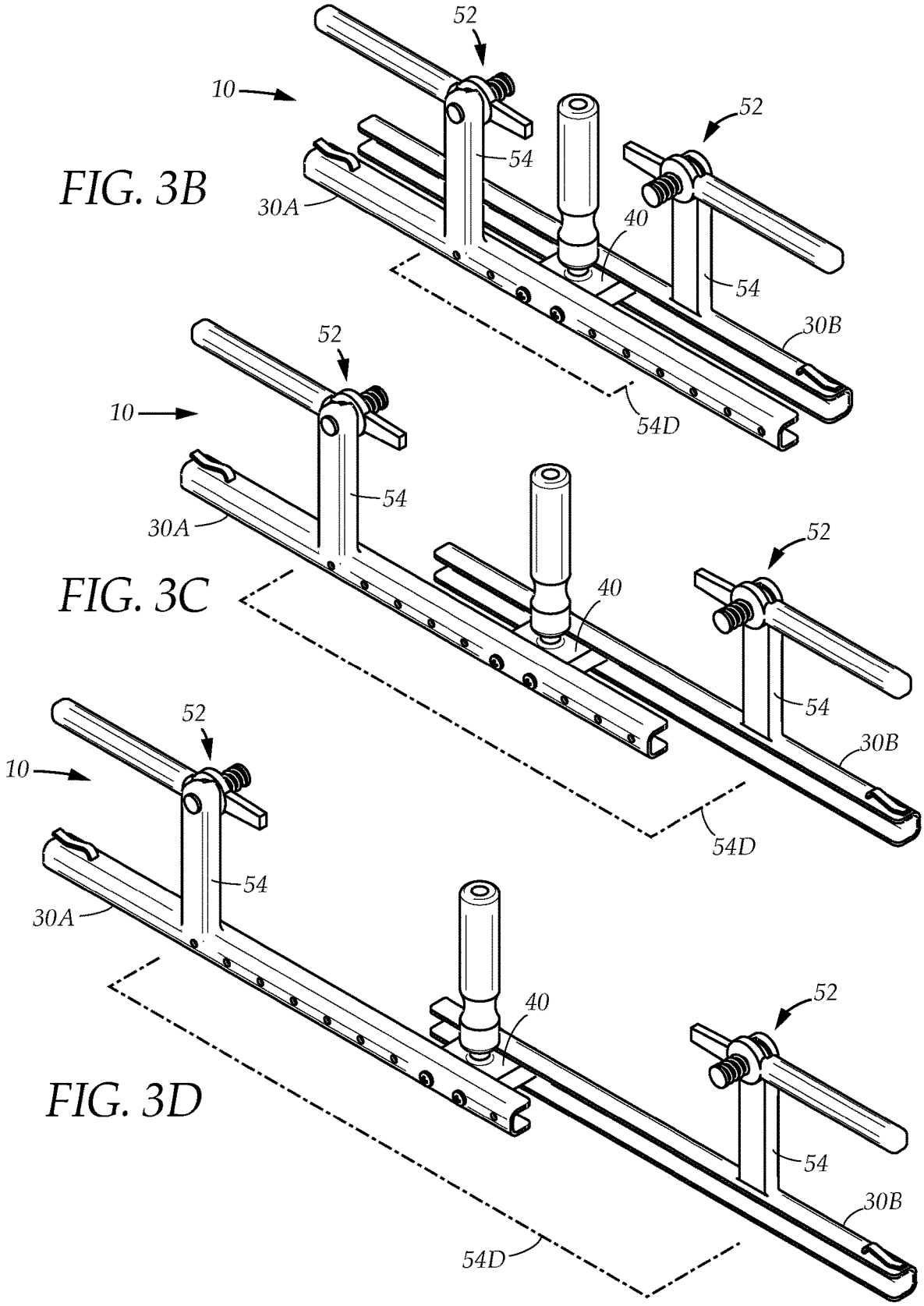
FIG. 3B is a diagrammatic perspective view of the adjustable spooling apparatus, depicting the adjustable arms in a retracted position, in accordance with an embodiment in the present disclosure.
FIG. 3C is a diagrammatic perspective view of the adjustable spooling apparatus, depicting the adjustable arms in a partially extended position which increases a retention member distance between the coil retention assemblies, in accordance with an embodiment in the present disclosure.
FIG. 3D is a diagrammatic perspective view of the adjustable spooling apparatus, depicting the adjustable arms in an extended position which substantially increases the retention member distance, in accordance with an embodiment in the present disclosure.

Referring to FIGS. 3B-D while also referring to FIG. 1 and FIG. 2, the adjustable arms 30 may be selectively extended or retracted to either increase or decrease a retention member distance 54D. The retention member distance 54D is measured from the retention member 54 of the first adjustable arm 30A to the retention member 54 of the second adjustable arm 30B. The adjustable arms 30 may therefore be extended or retracted until the retention member distance 54D substantially matches the coil diameter 11D, thus allowing the adjustable spooling apparatus 10 to be used with pre-wound coils 110 of varying coil diameters 11D without winding the cable 11 directly over the retention members 54.

Figure 7A:
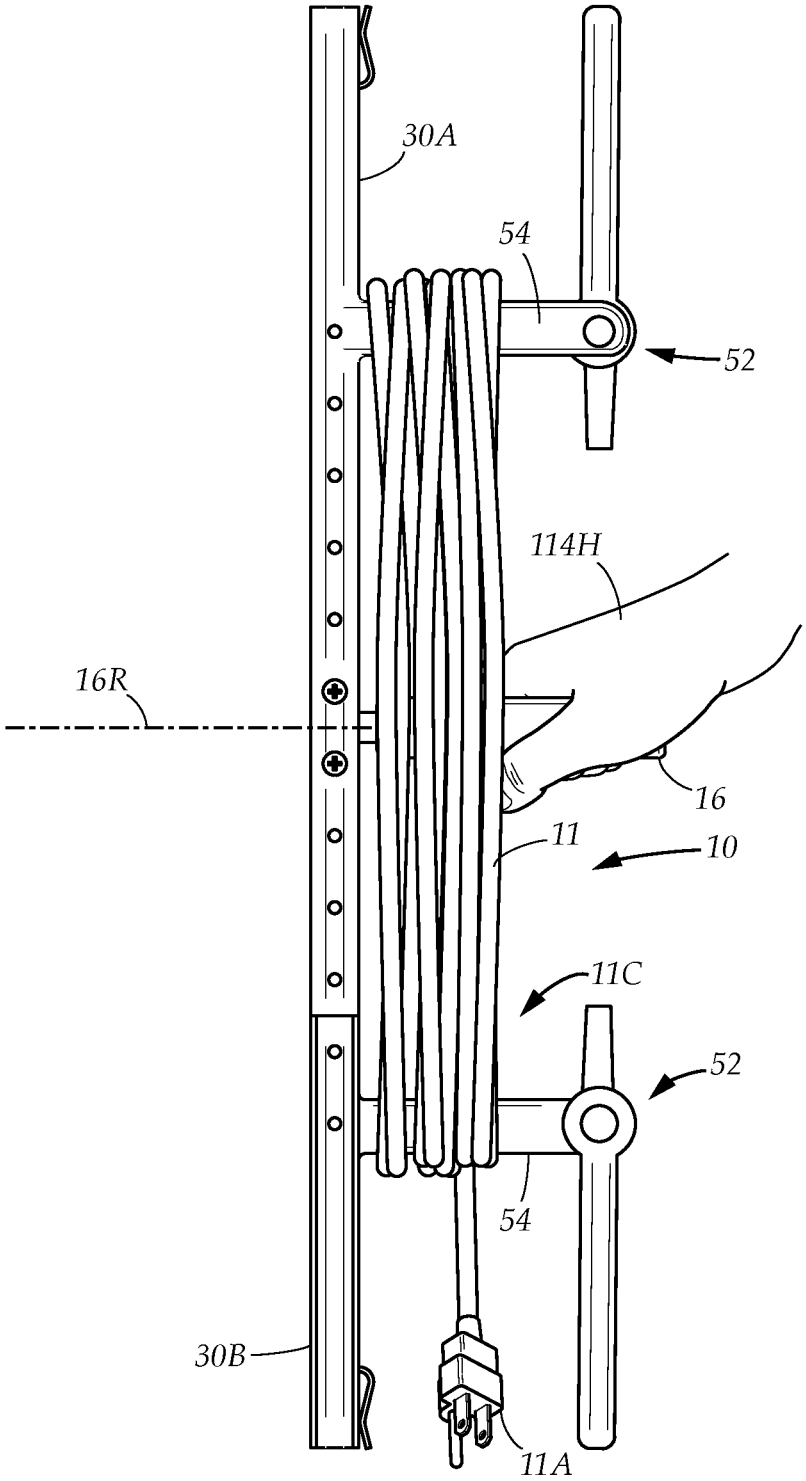
FIG. 7A is a diagrammatic side view of a user holding the adjustable spooling apparatus via the rotating handle which allows the apparatus to rotate as the coil is unwound, in accordance with an embodiment in the present disclosure.

Referring to FIG. 7A, once the coil 11C has been secured to the adjustable spooling apparatus 10, the user may unwind the cable coil 11C by grasping the rotating handle 16 by hand 114H, and pulling on one of the cable ends 11A. The adjustable spooling apparatus 10 will rotate around an axis of rotation 16R passing centrally through the rotating handle 16, allowing the coil 11C to be steadily unwound. The adjustable spooling apparatus 10 may rotate either clockwise or counterclockwise in relation to the rotating handle 16, opposite the direction in which the cable 11 is wound within the coil 11C. In a preferred embodiment, the cable 11 is pulled laterally in relation to the axis of rotation 16R.

Returning to FIG. 1 while also referring to FIG. 3A, in one embodiment, the central hub 40 has a first face 42A and a second face 42B disposed opposite thereof. The rotating handle 16 projects perpendicularly away from the first face 42A. The central hub 40 may also have a first side 44A and a second side 44B oriented in parallel astride the rotating handle 16. The central hub 40 further has a pair of extension guides comprising a first extension guide 46A and a second extension guide 46B, which facilitate the extension and retraction of the adjustable arms 30. The first and second extension guides 46A, 46B may be positioned at the first and second sides 44A, 44B of the central hub 40.

The first and second extension guides 46A, 46B engage with and maintain the first and second adjustable arms 30A, 30B in a parallel arrangement with the central hub 40 positioned therebetween. The adjustable arms 30 extend and retract by sliding along the first or second extension guides 46A, 46B.

In a preferred embodiment, each adjustable arm 30 has a first end 32A and a distally oriented second end 32B. The adjustable arms 30 may be formed using a shaft, beam, rod, tube, bar, or other appropriate linear structural member. Furthermore, each adjustable arm 30 may further have an upper face 34A, a lower face 34B, an inner face 36B, and an outer face 36A. In certain embodiments, such as where the adjustable arms 30 are formed using tubes with elliptical cross sections which lack distinct planar faces, the upper face 34A, lower face 34B, inner face 36B, and outer face 36A are used to describe portions of the adjustable arm 30 in spatial terms relative to the central hub 40. When each adjustable arm 30 is engaged with the central hub 40 via the first or second extension guide 46A, 46B, the upper face 34A is oriented in the same direction as the first face 42A of the central hub 40 while the lower face 34B is oriented in the same direction as the second face 42B. Likewise, the inner face 36B is oriented towards the opposite adjustable arm 30, while the outer face 36A is oriented away from the opposite adjustable arm 30. In a preferred embodiment, each coil retention member 54 is positioned closer to the first end 32A of the adjustable arm 30 than to the second end 32B, and projects perpendicularly from the upper face 34A.

Referring to FIG. 3A as well as FIG. 1, the sliding engagement between the adjustable arms 30 and the first and second extension guides 46A, 46B may be implemented in various configurations. In one embodiment, each adjustable arm 30 has an adjustment channel 38 formed on the inner face 36B, which extends longitudinally between the first and second ends 32A, 32B of the adjustable arm 30. The adjustment channel 38 may be formed as a linear depression, recess, or hollow space extending along the inner face 36B, and first and second extension guides 46A, 46B are adapted to slot into the adjustment channel 38, thus creating the sliding engagement between the central hub 40 and the adjustable arm 30.

In the example embodiment pictured in FIG. 3A and FIG. 1, the adjustable arm 30 is formed as a hollow tube with a rectangular cross section and an adjustment channel inner surface 38N. The inner face 36B is open, thus forming the adjustment channel 38 which also exposes the adjustment channel inner surface 38N. The first and second extension guides 46A, 46B have a rectangular cross section and are adapted to engage with the adjustment channel inner surface 38N.

In alternative embodiments, the first and second extension guides 46A, 46B may be adapted to enclose the adjustable arms 30, and may each be formed as a bracket, sleeve, or tube through which each adjustable arm 30 is inserted. In such embodiments, the adjustable arms 30 are held in place by the first or second extension guides 46A, 46B, and can be extended or retracted by sliding within the first or second extension guide 46A, 46B.

Referring to FIG. 1 and FIGS. 3A-D, in one embodiment, the adjustable spooling apparatus 10 further has an arm locking mechanism 39 which maintains the position of the adjustable arms 30 relative to the central hub 40 to prevent the retention member distance 54D from being altered after the adjustable arm 30 is extended or retracted. In one embodiment, the arm locking mechanism 39 comprises a locking pin 39B which passes through one of the adjustable arms 30 to secure the adjustable arm 30 to the central hub 40. Each adjustable arm 30 may have one or more arm locking channels 37, and the central hub 40 may have one or more hub locking channels 47L positioned proximate the first side 44A and the second side 44B. The locking pin 39B may be a bolt, screw, or other threaded or unthreaded pin which passes through the arm locking channel 37, and engages the hub locking channel 47L. The locking pin 39B can be removed or otherwise disengaged prior to extending or retracting the adjustable arm 30.

The arm locking channels 37 may be positioned on the upper face 34A, lower face 34B, or the outer face 36A. The hub locking channels 47L may be positioned on the first face 42A, second face 42B, the first side 44A, or the second side 44B as appropriate to align with the arm locking channels 37.

In one embodiment illustrated in FIG. 1 and FIG. 3A, the arm locking channels 37 may be configured as a series of circular holes spaced at regular intervals between the first end 32A and the second end 32B. The arm locking channels 37 are disposed along the outer face 36A of the adjustable arms 30, and the locking pin 39B is configured as a threaded bolt.

Alternatively, the arm locking channel 37 may be formed as a linear slit extending between the first and second ends 32A, 32B to allow for adjustments to the retention member distance to be made continuously along any point of the arm locking channel 37 without intervals. The locking pin 39B can be loosened to allow the adjustable arm 30 to extend or retract, and can be tightened to fix the adjustable arm 30 in place.

Figure 5:
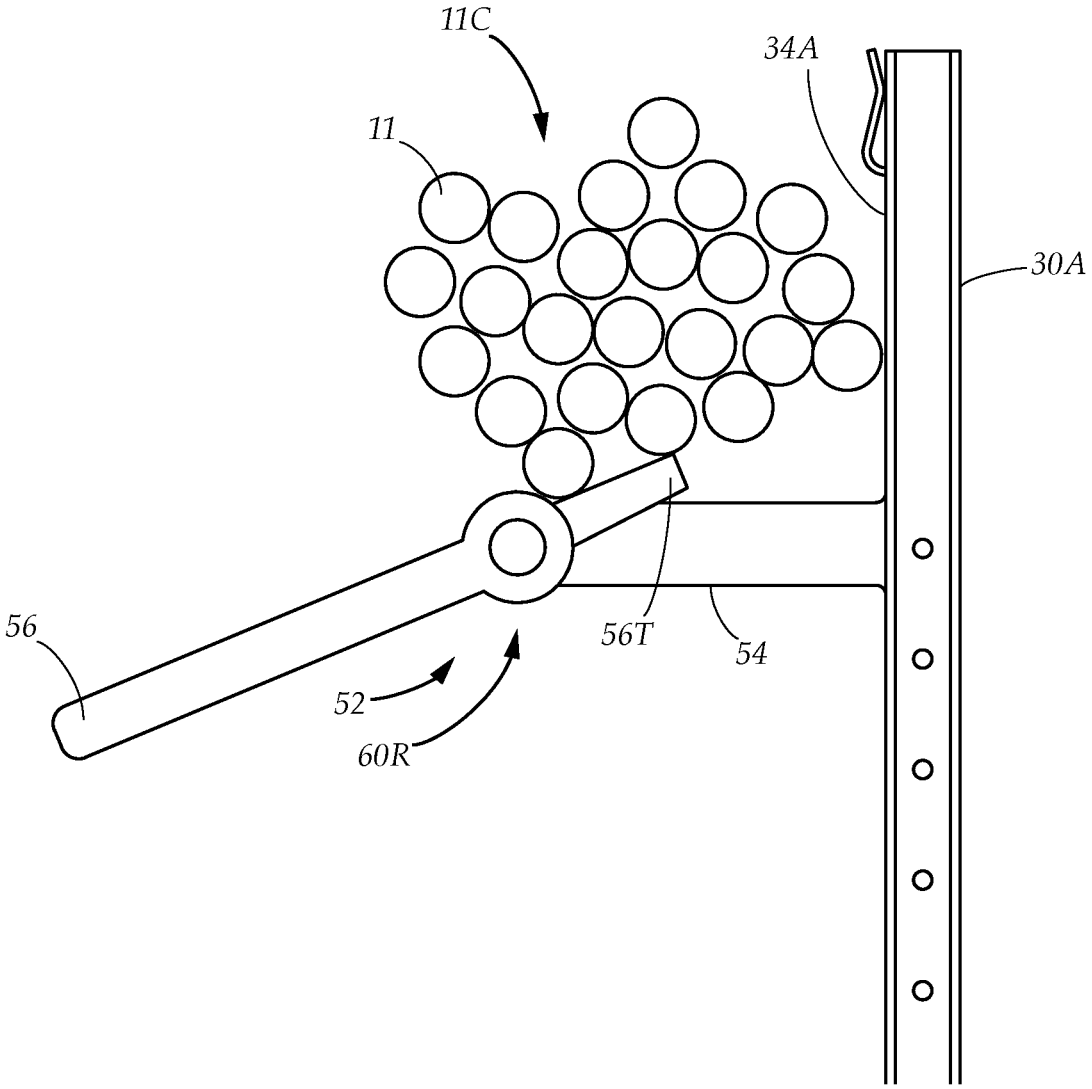
FIG. 5 is a diagrammatic side view of the coil being placed on the adjustable spooling apparatus adjacent to one of the coil retention assemblies, in accordance with an embodiment in the present disclosure.
Figure 6:
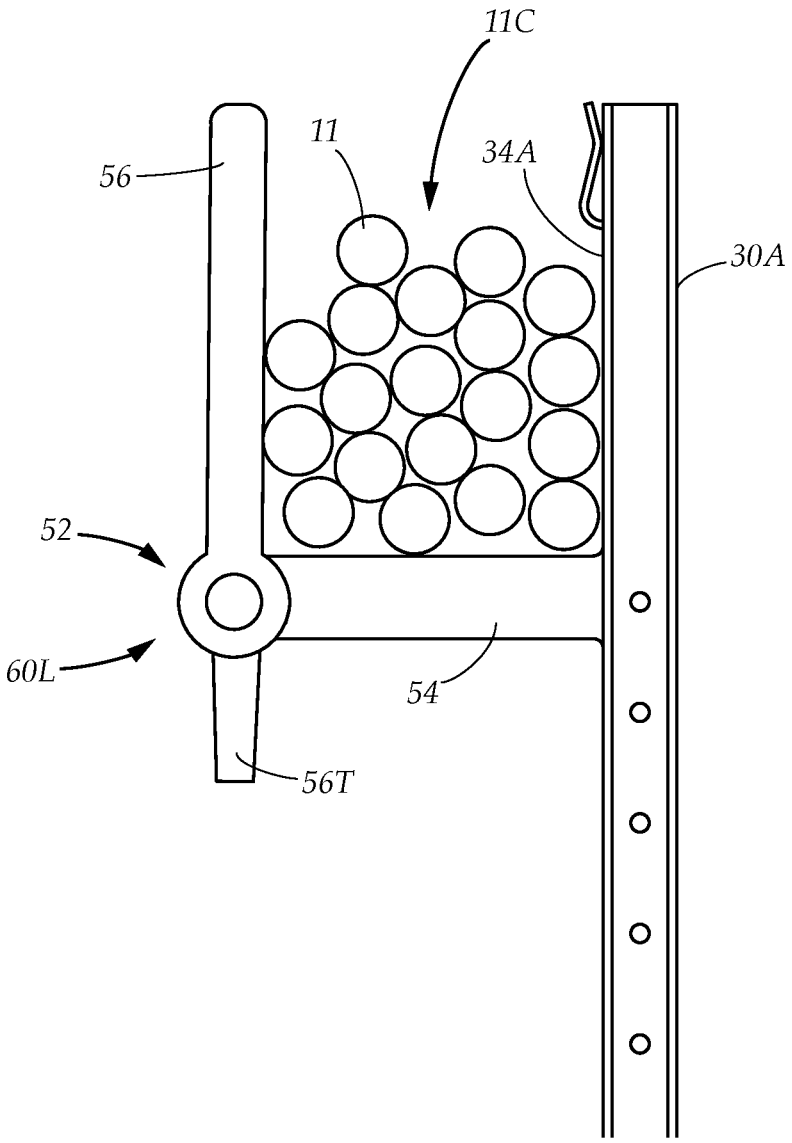
FIG. 6 is a diagrammatic side view of a pivoting arm being lowered to secure the coil in place against the adjustable arm, in accordance with an embodiment in the present disclosure.

Referring to FIG. 1 while also referring to FIGS. 5-6, in addition to allowing the coil 11C to be held around the coil retention members 54, the coil retention assemblies 52 each further comprise a pivoting arm 56 which further prevents the coil 11C from slipping free of the coil retention members 54 if the adjustable spooling apparatus 10 is tilted. The pivoting arm 56 is adapted to pivot between a raised position 60R and a lowered position 60L. When the pivoting arm 56 is placed in the lowered position 60L, it may exert a force against the coil 11C which pushes the coil 110 against the adjustable arm 30.

Figure 8A:
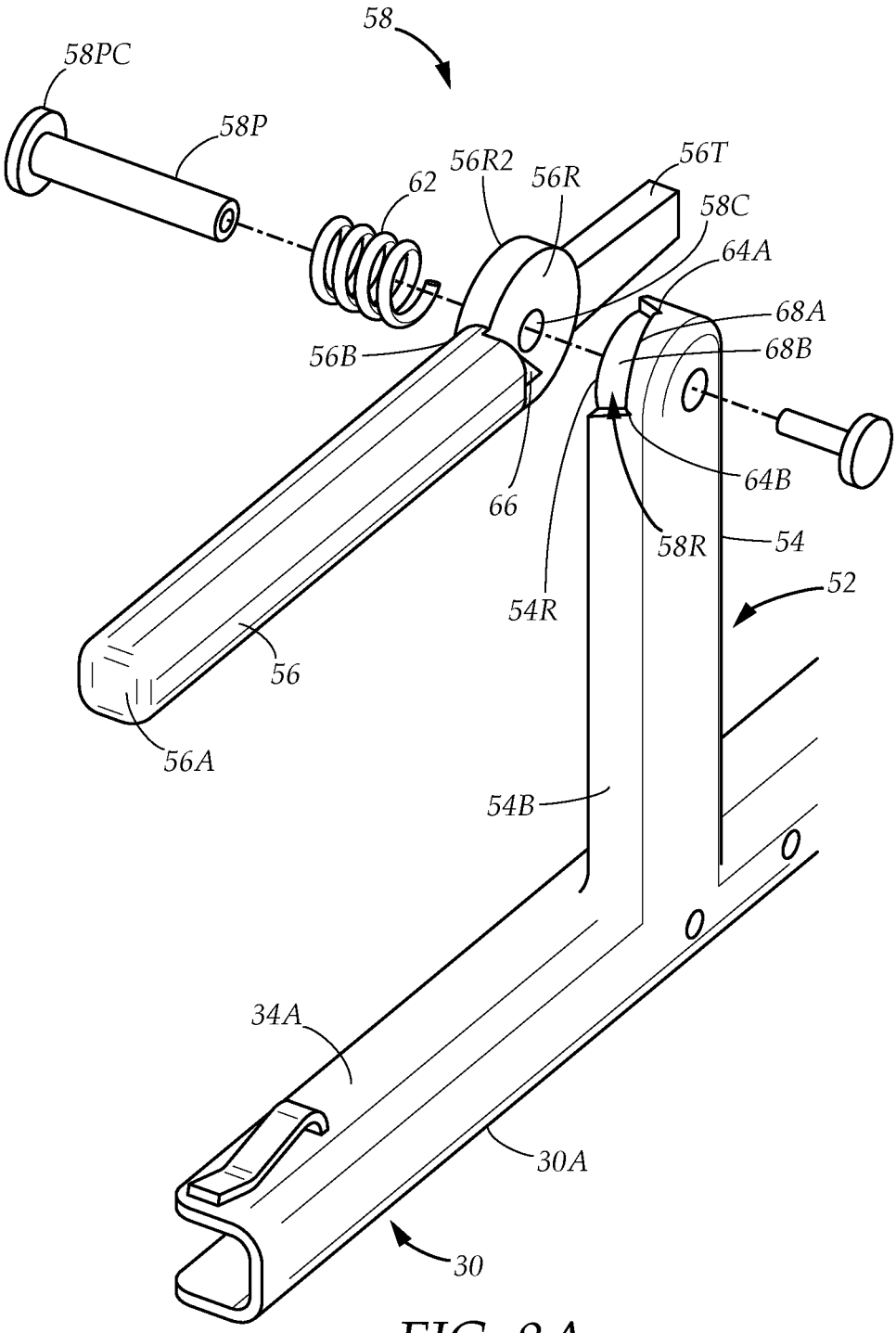
FIG. 8A is a diagrammatic exploded view of one of the coil retention assemblies, showing an actuation spring and selective release mechanism, in accordance with an embodiment in the present disclosure.
Figure 8B:
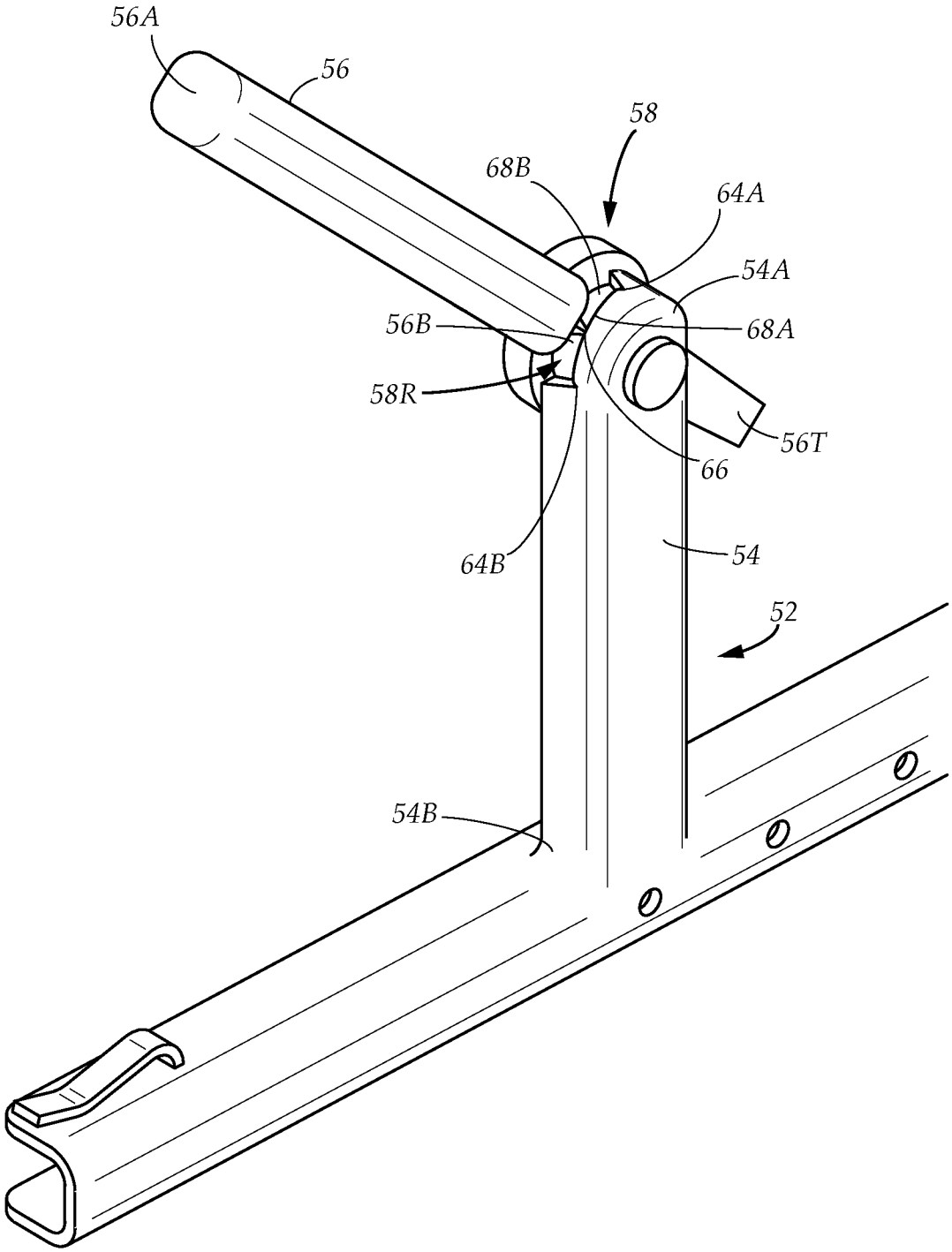
FIG. 8B is a diagrammatic perspective view of the assembled coil retention assembly, showing the selective release mechanism with a guide tooth that moves along an angled guide ramp between a first groove and a second groove, in accordance with an embodiment in the present disclosure.

Referring to FIG. 8A-B while also referring to FIG. 1 and FIGS. 5-6, the coil retention member 54 has a coil retention member first end 54A and a coil retention member second end 54B oriented distally therefrom. In a preferred embodiment, the coil retention member second end 54B is attached to the upper face 34A of the adjustable arm 30, and the coil retention member first end 54A projects away from the upper face 34A. The pivoting arm 56 has a pivoting arm first end 56A and a pivoting arm second end 56B disposed distally therefrom. The coil retention member 54 further has a pivoting arm hinge 58, which joins together the pivoting arm 56 and the coil retention member 54.

The pivoting arm 56 may have a pivoting arm hinge face 56R positioned at the pivoting arm second end 56B, while the coil retention member 54 has a retention member hinge face 54R positioned at the coil retention member first end 54A. In a preferred embodiment, the pivoting arm 56 and the coil retention member 54 form a hinged contact between the coil retention member hinge face 54R and the pivoting arm hinge face 54R. The pivoting arm 56 and the coil retention member 54 each have a hinge channel 58C which passes through the coil retention hinge face 54R and the pivoting arm hinge face 56R respectively. The coil retention assembly 52 further has a pivot pin 58P which passes through the hinge channels 58C of the pivoting arm 56 and the coil retention member 54 to complete the pivoting arm hinge 58, allowing the pivoting arm 56 to pivot about the pivot pin 58P.

In a preferred embodiment, the pivoting arm 56 is positioned such that the pivoting arm first end 56A is oriented towards the adjustable arm first end 32A when in the lowered position 60L. When the pivoting arm 56 is placed in the raised position 60R, the pivot arm first end 56A is raised away from the adjustable arm upper face 34A. In some embodiments, the pivoting arm hinge 58 allows the pivoting arm 56 to be pivoted past a 90 degree mark which is colinear with retention member 54, thus allowing the pivoting arm first end 56A to point towards the adjustable arm second end 34A.

When the pivoting arms 56 of each of the two coil retention assemblies 52 are placed in the raised position 60R, the pivoting arms 56 do not block the placement of the coil 11C upon the adjustable spooling apparatus 10. The coil 11C may be placed in contact with the adjustable arms 30 such that the cable 11 contacts each adjustable arm 30 on its upper face 34A between the coil retention member 54 and the first end 32A of the adjustable arm 30. Once the coil 11C is in position surrounding the coil retention members 54, the pivoting arms 56 are placed in the lowered position 60L to push the coil 11C against the upper face 34A of the adjustable arms 30. In use cases where the coil 11C is of insufficient thickness to allow the pivoting arms 56 to directly push against the coil 11C, the pivoting arms 56 may still prevent the coil 11C from being dislodged, by preventing the coil 11C from being lifted away from the upper face 34A of the adjustable arm 30.

In one embodiment, the lowered position 60L places the pivoting arm 56 approximately parallel with the adjustable arm 30, or substantially perpendicular in relation to the coil retention member 54. The raised position 60R may elevate the pivoting arm 56 by approximately ninety degrees or greater in relation to the adjustable arm 30.

In a preferred embodiment, the pivoting arm hinge 58 further has an actuation mechanism which automatically lowers the pivoting arm 56 from the raised position 60R to the lowered position 60L when the coil 11C is placed around the coil retention members 54.

In one embodiment, the pivoting arm 56 further has a triggering arm 56T which projects from the pivoting arm second end 56B. In a preferred embodiment, the triggering arm 56T is substantially colinear with the pivoting arm 56 and projects away from the pivoting arm second end 56B at an angle of approximately one hundred eighty degrees. When the pivoting arm 56 is placed in the raised position, the pivoting arm first end 56A points away from the adjustable arm 30, while the triggering arm 56T projects away from the pivoting arm hinge 58 towards the adjustable arm first end 32A. The triggering arm 56T has sufficient length to impede the placement of the coil 11C, thus causing the coil 11C to contact the triggering arm 56T while being lowered towards the upper surface 34A of the adjustable arms 30.

In alternative embodiments, the triggering arm 56T can be positioned at various angles in relation to the pivoting arm 56. For example, the triggering arm 56T may be separated from the pivoting arm 56 by between ninety-degrees to one hundred eighty degrees.

In a preferred embodiment, the actuation mechanism is an actuation spring 62, which utilizes spring tension to lower the pivoting arm 56 from the raised position 60R to the lowered position 60L. The pivoting arm hinge 58 further has a selective release mechanism 58R which allows the pivoting arm 56 to be releasably locked in the raised position 60R and temporarily offsets the actuating force of the actuation spring 62. The contact between the coil 11C and the triggering arm 56T triggers the selective release mechanism 58R and allows the actuating force to push against the pivoting arm 56, causing the pivoting arm 56 to automatically pivot to the lowered position 60L.

In one embodiment, the selective release mechanism 58R comprises a guide tooth 66 positioned on the pivoting arm second end 56B, and a first groove 64A positioned on the coil retaining member first end 54A. The first groove 64A opens towards the pivoting arm hinge face 56R, while the guide tooth 66 may project away from the pivoting arm hinge face 56R towards the retention member hinge face 54R, to align with the first groove 64A. When the pivoting arm 56 is placed in the raised position 60R, the guide tooth 66 engages with the first groove 64A and releasably locks the pivoting arm 56 in the raised position 60R. When the coil 11C contacts the trigger arm 56T, the guide tooth 66 is dislodged and disengages from the first groove 64A, thus allowing the actuation spring 62 to push the pivoting arm 56 towards the lowered position 60L. In certain embodiments, the coil retaining member 54 further has a second groove 64B which is positioned between the first groove 64A and the coil retaining member second end 54B. The second groove 64B is positioned to engage with the guide tooth 66 once the pivoting arm 56 reaches the lowered position 60L, thus preventing the pivoting arm 56 from lowering further than the lowered position 60L.

In one embodiment, the pivoting arm 56 has a pivoting arm hinge outer face 56R2 which is disposed opposite the pivoting arm hinge face 56R. The actuation spring 62 may be a coiled compression spring which is positioned at the pivoting arm hinge outer face 56R2. The pivot pin 58P passes centrally through the actuation spring 62 and the hinge channels 58C of the pivoting arm hinge 58, and has a pivot pin flange 58PC which compresses the actuation spring 62, thus causing the actuation spring 62 to push against the pivoting arm hinge outer face 56R2.

To assist the pivoting of the pivoting arm 56 by the actuation spring 62, the coil retention member 54 may have an angled guide ramp 68A positioned at the coil retention member hinge face 54R which extends between the first groove 64A and the second groove 64B and faces towards the pivoting member hinge face 56R. The guide tooth 66 travels along the angled guide ramp 68A as it moves between the first groove 64A and the second groove 64B. As the angled guide ramp 68A approaches the second groove 64B, the angled guide ramp 68A gradually extends away from the coil retention member hinge face 54R. The angled guide ramp 68A therefore causes the compression of the actuation spring 62 to increase pushing the pivoting arm hinge face 56R away from the cable retention member hinge face 54R as the guide pivoting arm 56 is brought towards the raised position 60R. The compression of the actuation spring 62 is at its greatest when the guide tooth 66 engages the first groove 64A. Once the trigger arm 56T is contacted and the guide tooth 66 is disengaged from the first groove 64A, the actuation spring 62 pushes against the rotating arm hinge outer face 56R2, causing the guide tooth 66 to move along the angled guide ramp 68A towards the second groove 64B.

In certain embodiments, the coil retention member first end 54A further has a recessed guide surface 68B which extends from the angled guide ramp 68A to the coil retention member hinge face 54R. The recessed guide surface 68B allows the guide tooth 66 to move smoothly between the first notch 64A and the second notch 64B.

Note that the actuation spring 62 may be implemented using other configurations, to achieve the automatic pivoting of the pivoting arm 56 in accordance with the principles described in the present disclosure. In one alternative embodiment, the actuation spring 62 may be a torsion spring with two arms positioned internally within the hinge channels 58C of the pivoting arm hinge 58, with the pivot pin 58P passing centrally through the torsion spring. The pivoting arm 56 and the coil retention member 54 may further have arm channels which are accessible to the hinge channels 58C to accommodate the arms of the torsion spring, thus allowing the torsion spring to actuate the pivoting arm 56.

Figure 9A:
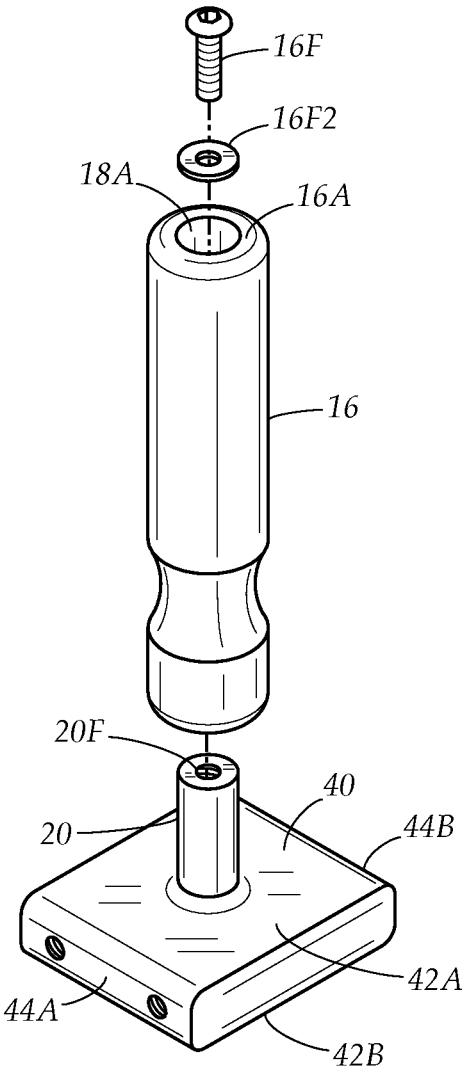
FIG. 9A is a diagrammatic exploded view of the rotating handle attached to a rotation shaft projecting from the central hub, in accordance with an embodiment in the present disclosure.
Figure 9B:
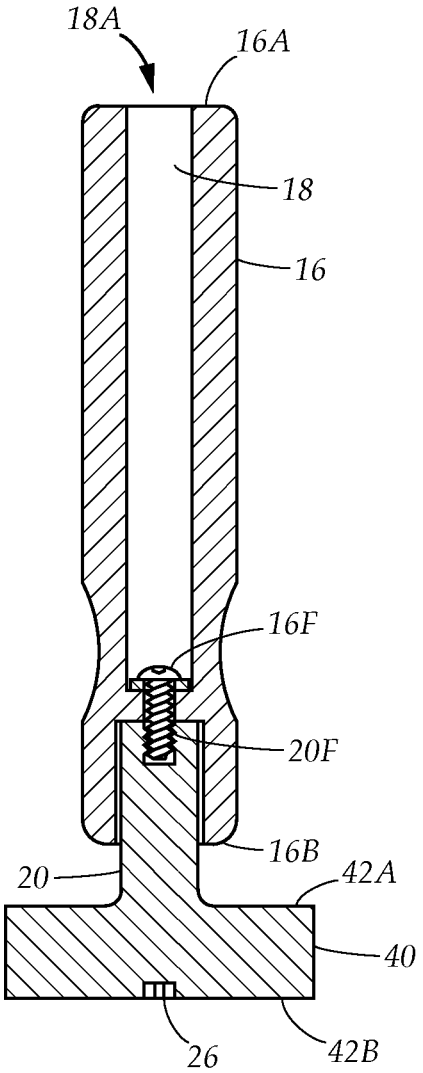
FIG. 9B is a cross sectional view of the rotating handle showing the mounting recess, in accordance with an embodiment in the present disclosure.

Referring to FIGS. 9A-B while also referring to FIG. 2 and FIG. 7A, in one embodiment, the rotating handle 16 has a handle first end 16A and a distally oriented handle second end 16B. The rotating handle 16 is attached to the first face 42A of the central hub 40 via a rotation mechanism. In one embodiment, the rotation mechanism corresponds to a rotation shaft 20 which projects perpendicularly from the first face 42A of the central hub 40 and is joined to the handle second end 16B. The axis of rotation 16R passes longitudinally through the rotation shaft, the handle second end 16B, and the handle first end 16A.

In one embodiment, the rotation shaft 20 is fixed in place, and has a rotation shaft first end 20F which projects away from the central hub 40. The rotating handle 16 is attached to the rotation shaft 20 via a combination of a fastener 16F, such as a bolt or screw, and a washer 16F2 or bearing which allows the rotating handle 16 to rotate about the axis of rotation 16R.

In an alternate embodiment, the rotation shaft 20 may instead be fixed to the handle second end 16B. The rotation shaft 20 may then pass through a rotation channel which extends from the first face 42A of the central hub towards the second face 42B, allowing the rotating handle 16 and the rotation shaft 20 to rotate within the rotation channel. In certain embodiments, the rotation shaft 20 may pass through the second face 42B of the central hub, where it is attached to a secondary head. The secondary head may be configured as a cap which prevents the rotation shaft 20 from being withdrawn through the rotation channel.

Figure 7B:
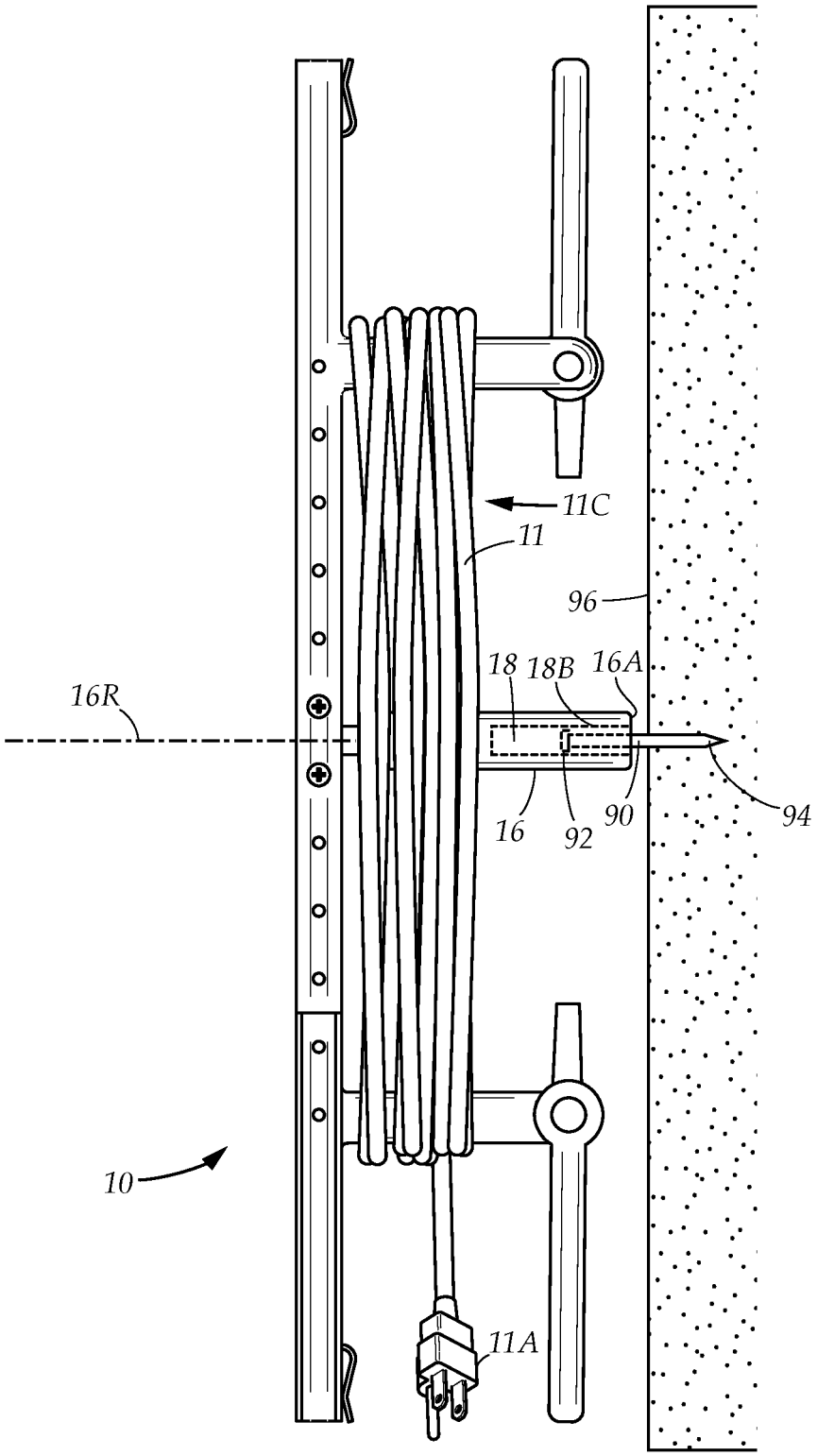
FIG. 7B is a diagrammatic side view of the adjustable spooling apparatus mounted to a vertical surface, via a mounting peg inserted through the rotating handle, in accordance with an embodiment in the present disclosure.

Referring to FIG. 7B along with FIG. 7A and FIGS. 9A-B, the adjustable spooling apparatus 10 may be secured to a vertical surface 96, such as a wall, vertically oriented beam, or other similar surface, thus allowing the coil 11C to be unwound without grasping the rotating handle 16 by hand 114H. In a preferred embodiment, the adjustable spooling apparatus 10 may be secured to a mounting peg 90 which projects from the vertical surface 96. The mounting peg 90 has a mounting peg first end 92, and a mounting peg second end 94 which is attached to, or otherwise embedded within, the vertical surface 96. The mounting peg can be a screw, nail, bolt, rod, or similar object.

The rotating handle 16 may have a mounting recess 18 which is accessible from a mounting recess opening 18A positioned at the handle first end 16A. The mounting recess 18 corresponds to an internal space within the rotating handle which extends from the mounting recess opening 18A inwardly towards the handle second end 16B, and the mounting recess opening 18A is adapted to receive the mounting peg first end 94. This allows the rotating handle 16 to be placed over the mounting peg 90 such that adjustable spooling apparatus 10 is substantially parallel with the vertical surface 96.

With the rotating handle 16 thus secured to the vertical surface 96 via the mounting peg 90, pulling the one of the cable ends 11A, 11B causes the adjustable spooling apparatus 10 to rotate about the axis of rotation 16R, allowing the cable 11 to be unwound. Furthermore, the user is able to move away from the adjustable spooling apparatus while continuing to unwind the cable 11.

Figure 11A:
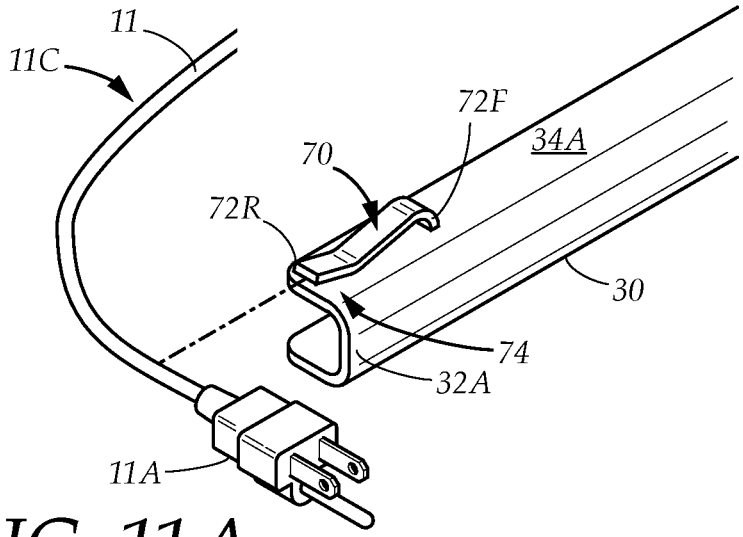
FIG. 11A is a diagrammatic perspective view of a retention clip positioned on one of the adjustable arms, in accordance with an embodiment in the present disclosure.
Figure 11B:
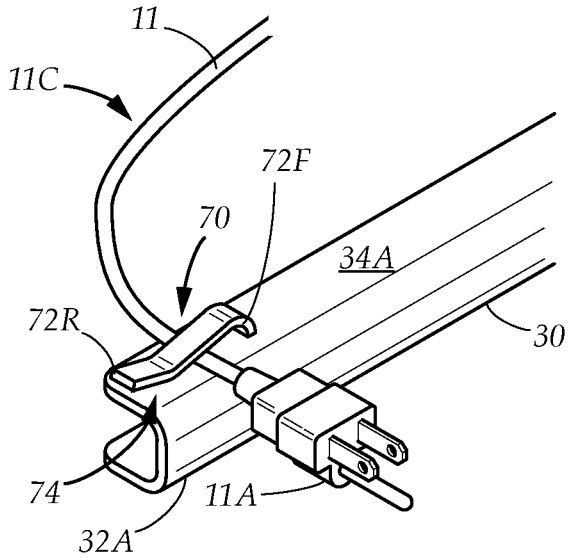
FIG. 11B is a diagrammatic perspective view of the cable being retained by the retention clip, in accordance with an embodiment in the present disclosure.

Turning to FIGS. 11A-B while also referring to FIG. 2, in certain use cases, when the first and second cable ends 11A, 11B are unsecured, it may be possible for the cable 11 to dangle and become loosened when the adjustable spooling apparatus 10 is handled or moved, causing the coil 11C to partially unwind while still retained on the adjustable spooling apparatus 10. Therefore, each adjustable arm 30 may further have a retention clip 70 positioned between the coil retention member 54 and the first end 32A of the adjustable arm 30. The retention clip 70 is adapted to releasably grip the cable 11 and prevent the coil 11C from being unwound prematurely.

The retention clip 70 is formed of a material capable of bending while retaining its shape, such as plastic or thin metal. In a preferred embodiment, the retention clip 70 has an elastic portion 72F which projects away from the adjustable arm 30, and a retention member 72R which projects angularly away from the elastic portion 72F towards the adjustable arm 30. The retention member 72R is separated from the adjustable arm 30 by a retention gap 74. The cable 11 may be inserted through the retention gap 74 to be held in place between the retaining member 72F and the adjustable arm 30. The cable 11 is prevented from being removed from the retention gap 74 by a retention force exerted by the retention clip 70. The cable 11 may be removed from the retention clip 70 by pulling the cable 11 with sufficient force to overcome the retention force and widen the retention gap 74.

Referring to FIGS. 7A-B while also referring to FIG. 2 and FIGS. 11A-B, in a preferred embodiment, the retention clip 70 is attached to the upper face 34A of the adjustable arm 30, and the retention member 72R points towards the first end 32A of the adjustable arm 30. When the coil 11C is retained on the adjustable spooling apparatus 10, the first and second cable ends 11A, 11B may be retained in the retention clips 70 of the first and second adjustable arms 30A, 30B. Prior to unwinding the coil 11C, the first cable end 11A is detached from the retaining clip 70 of the first adjustable arm 30A, thus freeing the first cable end to allow the cable 11 to be pulled.

Pulling the cable 11 away from the adjustable spooling apparatus 10 exerts a pulling force which causes the adjustable spooling apparatus 10 to rotate about the rotating handle 16 until the cable 11 is free of the cable retention assemblies 52, with only the second cable end 11B remaining attached to the retention clip 70 of the second adjustable arm 30B. The pulling force is directed laterally in relation to the axis of rotation 16R, to avoid entangling the cable 11 upon the pivoting arms 56.

Orienting the retention member 72R towards the first end 32A of the adjustable arm 30 therefore serves a specific purpose. The cable 11 may be enlarged at first and second cable ends 11A, 11B to account for power connectors and other similar elements. Therefore, the first and second cable ends 11A, 11B may be significantly wider than the cable 11. Positioning the retention member 72R laterally across the adjustable arm 30 would result in the second cable end 11B becoming obstructed by the retention member 72R when the cable 11 is pulled laterally in relation to the axis of rotation 16R. The orientation of the retention member 72R towards the first end 32A of the adjustable arm 30 prevents the second cable end 11B from being obstructed by the retention member 72R, thus allowing the cable 11 to be completely detached without altering the direction of the pulling force. Furthermore, in use cases where the user has moved away from the adjustable spooling apparatus 10 while unwinding the cable 11, there is no need for a user to return to the adjustable spooling apparatus 10 in order manually detach the cable second end 11B from the retention clip 70.

Figure 10:
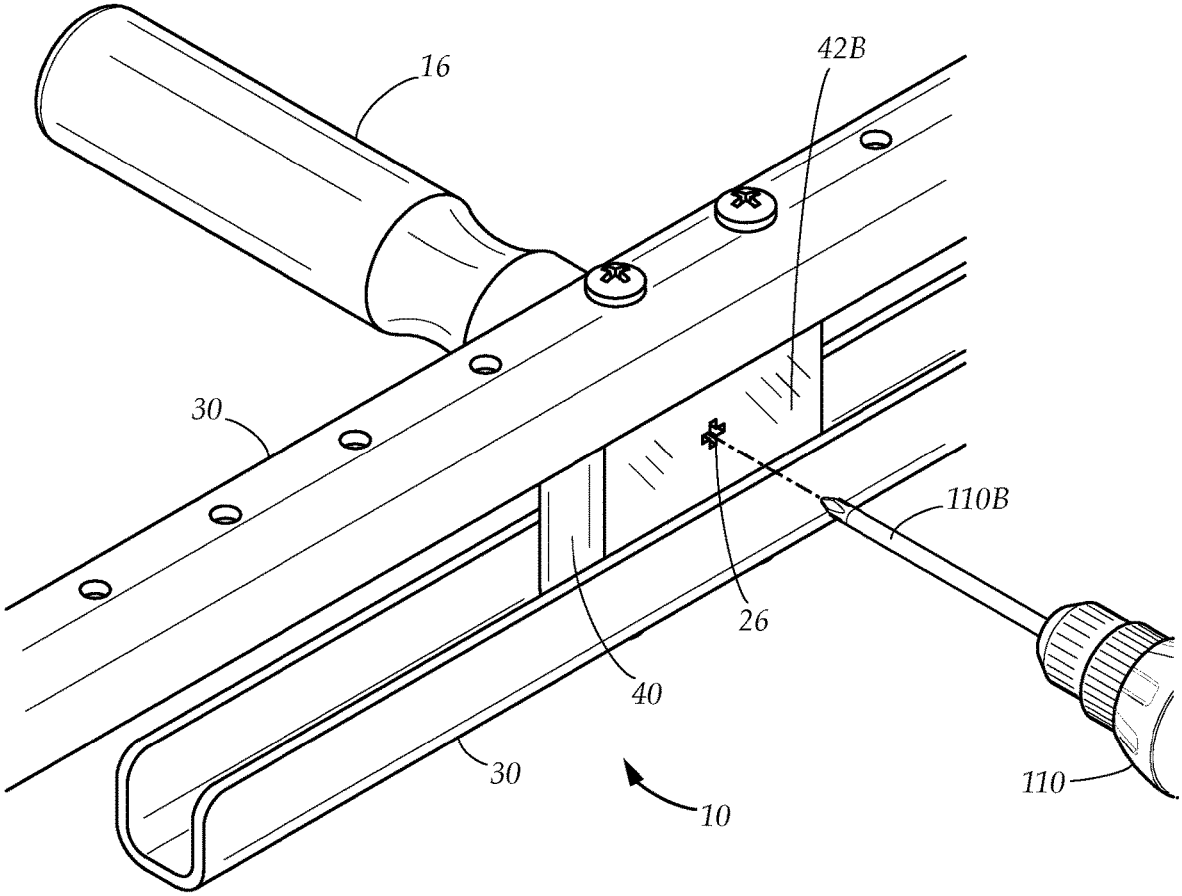
FIG. 10 is a diagrammatic perspective view showing an engagement point for receiving a power tool bit, in accordance with an embodiment in the present disclosure.

Turning to FIG. 9B and FIG. 10 while also referring to FIG. 2, and FIGS. 7A-B, in one embodiment, the adjustable spooling apparatus 10 is adapted to allow the cable 11 to be wound directly onto the coil retention assemblies 52, either by hand, or with the use of a power tool 110. The power tool 110 can be any device which exerts torque through a power tool bit 110B, such as an electric drill. The adjustable spooling apparatus 10 may therefore have an engagement point 26 facing away from the second face 42B of the central hub 40, which is positioned coaxially with the axis of rotation 16R. The engagement point 26 is adapted to receive the power tool bit 110B, thereby allowing the power tool 110 to apply torque to the central hub 40 which causes the adjustable spooling apparatus 10 to rotate about the axis of rotation 16R. The powered rotation of the adjustable spooling apparatus 10 allows the cable 11 to be rapidly wound over the coil retention members 54. To stabilize the adjustable spooling apparatus 10, the rotating handle 16 may either be grasped by hand, or be mounted to a vertical surface 96. Prior to rotating the adjustable spooling apparatus 10, the cable 11 may be secured to one of the retention clips 70 at a point near the second cable end 11B.

In one embodiment, the engagement point 26 is formed as a recess shaped to securely engage with the power tool bit 110B. For example, the engagement point 26 may be cross-shaped to engage with cross-shaped drill bits. The engagement point 26 may be configured in other shapes to facilitate engagement with other forms of power tools 110 and power tool bits 110B which are known to a person of ordinary skill in the art in the field of the invention. The engagement point 26 may be disposed directly on the second face 42B of the central hub 40, or another element attached thereto.

In one embodiment, the engagement point 26 may be positioned on the secondary head. The secondary head may be tightened to push directly against the central hub 40, thus allowing the torque applied by the power tool 110 to be applied directly to the central hub 40 while still allowing the rotating handle 16 to freely rotate in relation to the central hub 40.

Referring to FIGS. 3A-D while also referring to FIG. 2, the maximum and minimum potential retention member distances 54D are determined in part by the length of the adjustable arms 30, and the distance separating the first and second extension guides 46A, 46B. The minimum potential retention member distance 54D is achieved when the adjustable arms 30 are positioned with the coil retention members 54 of both adjustable arms 30 colinearly with a line that runs perpendicularly to the adjustable arms 30. The maximum potential retention member distance 54D can be increased by lengthening the adjustable arms 30. In one example provided for illustrative purposes, the minimum and maximum retention member distances 54D may correspond to three inches and thirteen inches respectively. The adjustable spooling apparatus 10 may accommodate greater lengths of cable 11 and correspondingly thicker coils 110 by increasing the lengths of the coil retention members 54 and the pivoting arms 56.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented an adjustable spooling apparatus. The disclosure is illustrated by example in the drawing figures, and throughout the written description. It should be understood that numerous variations are possible, while adhering to the inventive concept. Such variations are contemplated as being a part of the present disclosure.

What is claimed is:

1. An adjustable spooling apparatus for holding a coil of cable, the coil forming a coil central space, the coil central space having a coil diameter, the cable having a first end and a second end, the apparatus is adapted to be held by a user's hand or to be rotated by a rotating power tool with a tool bit, the apparatus is further adapted to be mounted to a vertical surface, the apparatus comprising:

a pair of adjustable arms comprising a first adjustable arm and a second adjustable arm, each adjustable arm having a first end and a second end, each adjustable arm further has a coil retention assembly comprising a coil retention member and a pivoting arm, each coil retention member is positioned proximate to the first end and projects orthogonally away from the adjustable arm, and each pivoting arm is hingedly attached to one of the coil retention members and is adapted to pivot between a raised position and a lowered position;

a central hub portion having a first face, a second face opposite thereof, a first extension guide, and a second extension guide, the first and second extension guides are adapted to receive the first adjustable arm and the second adjustable arm, allowing each adjustable arm to selectively retract inwardly to decrease a retention member distance measured between the retention members of the first and second adjustable arms, or extend outwardly to increase the retention member distance;

a rotating handle projecting away from the first face of the central hub, the rotating handle is adapted to rotate about an axis of rotation passing centrally through the central hub, the rotating handle is further adapted to be held by the user's hand;

whereby the adjustable arms are adapted to retain the coil by allowing the coil to be placed in contact with each adjustable arm between the coil retention member and the first end of the adjustable arm, and the pivoting arms are adapted to push downwardly upon the cable when placed in the lowered position to secure the coil against the adjustable arms; and whereby the central hub rotates about the rotating handle and the axis of rotation as the first end of the cable is pulled away from the adjustable spooling apparatus, allowing the coil to be unwound from around the coil retention members.

2. The adjustable spooling apparatus as described in claim 1, wherein the first and second extension guides hold the first and second adjustable arms in a parallel configuration with the first end of the first adjustable arm oriented in a direction opposite to the first end of the second adjustable arm.

3. The adjustable spooling apparatus as described in claim 2, wherein:

the rotating handle further has a handle first end, a handle second end oriented away from the handle first end, and a rotation shaft joining the handle second end with the central hub, the rotating handle is oriented perpendicularly to the adjustable arms.

4. The adjustable spooling apparatus as described in claim 3, wherein:

the central hub further has an engagement point disposed on the second face and positioned in line with the axis of rotation, the engagement point is adapted to engage with the tool bit of the power tool, allowing the power tool to rotate the adjustable spooling apparatus by applying torque to the central hub via the engagement point.

5. The adjustable spooling apparatus as described in claim 4, wherein the coil retention assemblies each further have an actuation spring which exerts an actuating force which moves the pivoting arm from the raised position to the lowered position.

6. The adjustable spooling apparatus as described in claim 5, wherein each coil retention assembly has a selective release mechanism and a triggering arm, the selective release mechanism offsets the actuating force and releasably locks the pivoting arm when the pivoting arm is placed in the raised position, and the triggering arm is adapted to cause the selective release mechanism to release the pivoting arm upon being physically contacted, allowing the actuating force to actuate the pivoting arm to the lowered position.

7. The adjustable spooling apparatus as described in claim 5, further comprising:

a mounting peg having a mounting peg first end and a mounting peg second end, the mounting peg second end is adapted to be attached to the vertical surface with the mounting peg first end projecting horizontally therefrom; and the rotating handle has a mounting recess formed as an opening facing away from the handle first end, the mounting recess is adapted to receive the mounting peg, allowing the central hub to rotate about the rotating handle while the rotating handle is attached to the vertical surface via the mounting peg.

8. The adjustable spooling apparatus as described in claim 7, wherein each adjustable arm further has a retention clip positioned between the first end and the coil retention member of the adjustable arm, the retention clip has an elastic portion which projects from the adjustable arm, and a retention member which projects angularly from the elastic portion towards the first end of the adjustable arm, each retention clip is adapted to exert a retention force for retaining the cable between the retention member and the adjustable arm, while also allowing the cable to be detached from the retention clip by overcoming the retention force.

9. A method for holding and unwinding a coil of cable, the coil forming a coil central space, the coil central space having a coil diameter, the cable having a first cable end and a second cable end, the method comprising the steps of:

providing an adjustable spooling apparatus having a pair of adjustable arms comprising a first adjustable arm and a second adjustable arm, a central hub having a first face and a second face opposite thereof, and a rotating handle which projects from the first face, each adjustable arm has a coil retention assembly having a coil retention member and a pivoting arm, the adjustable arms are positioned in parallel astride the central hub, are movably engaged to the central hub, and are adapted to extend and retract, the rotating handle is adapted to rotate about an axis of rotation passing centrally through the central hub;

adjusting the adjustable arms to increase or decrease a retention member distance by extending or retracting the adjustable arms, the retention arm distance being measured between the coil retention members of the first and second adjustable arms, and matching the retention arm distance to the coil diameter;

placing the coil onto the adjustable spooling apparatus with the coil retention members projecting into the coil central space and in contact with the cable adjoining the coil central space;

placing the pivoting arms in a lowered position to secure the coil against the adjustable arms;

securing the rotating handle;

pulling the first cable end in a direction lateral to the axis of rotation and causing the adjustable spooling apparatus to rotate about the axis of rotation; and unwinding the cable via the rotation of the adjustable spooling apparatus until the coil is freed from the coil retention assemblies.

10. The method as recited in claim 9, wherein:

each adjustable arm has a first end and a second end, and the first ends of the first and second adjustable arms point in opposing directions;

the coil retention member of each adjustable arm is positioned between the first end and the second of the adjustable arm;

each coil retention assembly has a trigger arm adapted to automatically lower the pivoting arm;

the step of adjusting the adjustable arms is followed by the step of placing each pivoting arm in a raised position whereby the pivoting arm points away from the adjustable arm and the triggering arm points towards the first end of the adjustable arm; and the step of placing the coil further comprises lowering the coil towards the adjustable arms and contacting the trigger arms.

11. The method as recited in claim 10, wherein:

each coil retention assembly further has an actuation spring for exerting an actuating force against the pivoting arm, and a selective release mechanism;

the step of placing each pivoting arm in a raised position further comprises releasably locking each pivoting arm in the raised position and offsetting the actuating force using the selective release mechanism;

the step of placing the coil further comprises the triggering arms unlocking the pivoting arms from the raised position; and the step of placing the pivoting arms in the lowered position further comprises lowering each pivoting arm using the actuating force exerted by the actuation spring.

12. The method as recited in claim 10, wherein:

each adjustable arm further has a retaining clip positioned between the first end and the coil retention member and which is oriented towards the first end;

the step of placing the pivoting arms in a lowered position is followed by the step of detachably securing the second cable end to one of the retention clips; and the step of unwinding the cable is followed by the step of detaching the second cable end from the retention clip by pulling the cable in a direction in line with the adjustable arm and pointing away from the first end.

13. The method as recited in claim 9, wherein:

the rotating handle is partially hollow and has a mounting recess; and the step of securing the rotating handle further comprises securing the rotating handle to a vertical surface, and fitting the rotating handle over a mounting peg projecting from the vertical surface by enclosing the mounting peg within the mounting recess.

14. The method as recited in claim 9 wherein the step of securing the rotating handle further comprises securing the rotating handle by a user grasping the rotating handle by hand.

15. The method as recited in claim 9, wherein:

the step of placing the coil onto the adjustable spooling apparatus is preceded by the step of preparing the coil by winding the cable around a thumb, forearm, and an elbow of a user, the coil distance matching a distance measured between the thumb and the elbow of the user.

16. The method as recited in claim 9, wherein:

the adjustable spooling apparatus further has an engagement point which is positioned at and facing away from the second face of the central hub and is colinear with the axis of rotation; and the step of unwinding the cable is followed by the step of receiving a power tool bit of a power tool via the engagement point, applying torque to the central hub via the power tool bit and causing the adjustable spooling apparatus to rotate about the axis of rotation, and winding the cable around the cable retention members using the rotation of the adjustable spooling apparatus.

* * * * *